US006157802A

United States Patent [19]

Jang

[11] Patent Number: 6,157,802

[45] Date of Patent: Dec. 5, 2000

[54] DEVELOPER FILTERING APPARATUS OF PRINTER

[75] Inventor: Jae-young Jang, Suwon, Rep. of Korea

[73] Assignee: SamSung Electronics Co., Ltd., Suwon, Rep. of Korea

[21] Appl. No.: 09/413,473

[22] Filed: Oct. 6, 1999

[30] Foreign Application Priority Data

Dec. 17, 1998 [KR] Rep. of Korea ..... 98-25359

[51] Int. Cl.[7] ..... G03G 15/10

[52] U.S. Cl. ..... 399/237; 399/245

[58] Field of Search ..... 399/237, 238, 399/239, 57, 233, 29, 245; 430/117–119; 210/226

[56] References Cited

U.S. PATENT DOCUMENTS 5,034,778 7/1991 Levanon et al. ..... 399/233 X

*Primary Examiner*—Quana Grainger
*Attorney, Agent, or Firm*—Robert E. Bushnell, Esq.

[57] ABSTRACT

A developer filtering apparatus of a printer, which filters developer supplied from a developing unit to a circulation tank through an discharge path, includes a coupling member having a hole formed therein and coupled to a coupling hole formed in the circulation tank to be capable of being detached, a receiving member extending to the inside of the circulation tank by penetrating the hole and for receiving developer discharged through the discharge path, and a filter net installed at one end of the coupling member wrapped around the receiving member for filtering developer passing through the receiving member.

19 Claims, 3 Drawing Sheets

DEVELOPER FILTERING APPARATUS OF PRINTER

CLAIM OF PRIORITY

This application makes reference to, incorporates the same herein, and claims all benefits accruing under 35 U.S.C. §119 from an application entitled A FILTERING APPARATUS FOR DEVELOPING SOLUTION OF PRINTER earlier filed in the Korean Industrial Property Office on Dec. 17, 1998 and there duly assigned Ser. No. 25359/1998.

BACKGROUND OF THE INVENTION

1. Field of the Invention

The present invention relates to a developer filtering apparatus of printer, and more particularly, to a developer filtering apparatus of a printer for filtering developer discharged to a circulation tank from a developing unit.

2. Description of the Related Art

In a typical liquid electrophotographic printer, an electrostatic latent image formed on a photoreceptor such as a photoreceptor drum or photoreceptor web is developed with developer having a predetermined color, and the developed image is transferred to a print paper so that a desired image is printed. The liquid electrophotographic printer includes a developing unit for developing the electrostatic latent image formed on the photoreceptor web by supplying developer to the photoreceptor web and a developer supplying apparatus for continuously supplying developer having a predetermined concentration to the developing unit.

In a conventional printer, a developing unit includes a developing roller for developing an electrostatic latent image formed on a photoreceptor web by a laser scanning unit with developer in which toner having a predetermined color and liquid carrier are mixed in a predetermined ratio.

Also, the developer supplying apparatus includes a developer supply path connecting a circulation tank and a developing unit, a pump installed on the developer supply path, and an injection nozzle installed at the leading end of the developer supply path for injecting developer between a predetermined gap G between the developing roller and the photoreceptor web. The developing unit is connected to the circulation tank by a discharge pipe to collect developer remaining after being used for development in the developing unit. Thus, the developer contained in the circulation tank is circulated between the developing unit and the circulation tank in a range of concentration allowance.

During the above circulation process, the developer may contain impurities due to fixation of toner or intrusion of foreign materials. Accordingly, it is necessary to filter impurities by installing a filter on the paths. However, there is no filtering means on the path to the circulation tank.

SUMMARY OF THE INVENTION

It is therefore an object of the present invention to provide an improved filtering apparatus for a printer.

It is also an object of the present invention to provide a filtering apparatus which is easily replaced or repaired.

Accordingly, to achieve the above objectives, there is provided a developer filtering apparatus of a printer for filtering developer supplied from a developing unit to a circulation tank through a discharge path, which includes a coupling member having a hole formed therein and coupled to a coupling hole formed in the circulation tank to be capable of being detached, a receiving member extending to the inside of the circulation tank by penetrating the hole and for receiving developer discharged through the discharge path, and a filter net installed at one end of the coupling member wrapped around the receiving member for filtering developer passing through the receiving member.

It is preferred in the present invention that the coupling member has a threaded portion formed thereon to be screw-coupled to the coupling hole.

Also, it is preferred in the present invention that the receiving member is comprised of a large diameter portion for receiving developer discharged from an end portion of the discharge path, and a small diameter portion extended from the large diameter portion and penetrating the hole of the coupling member.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
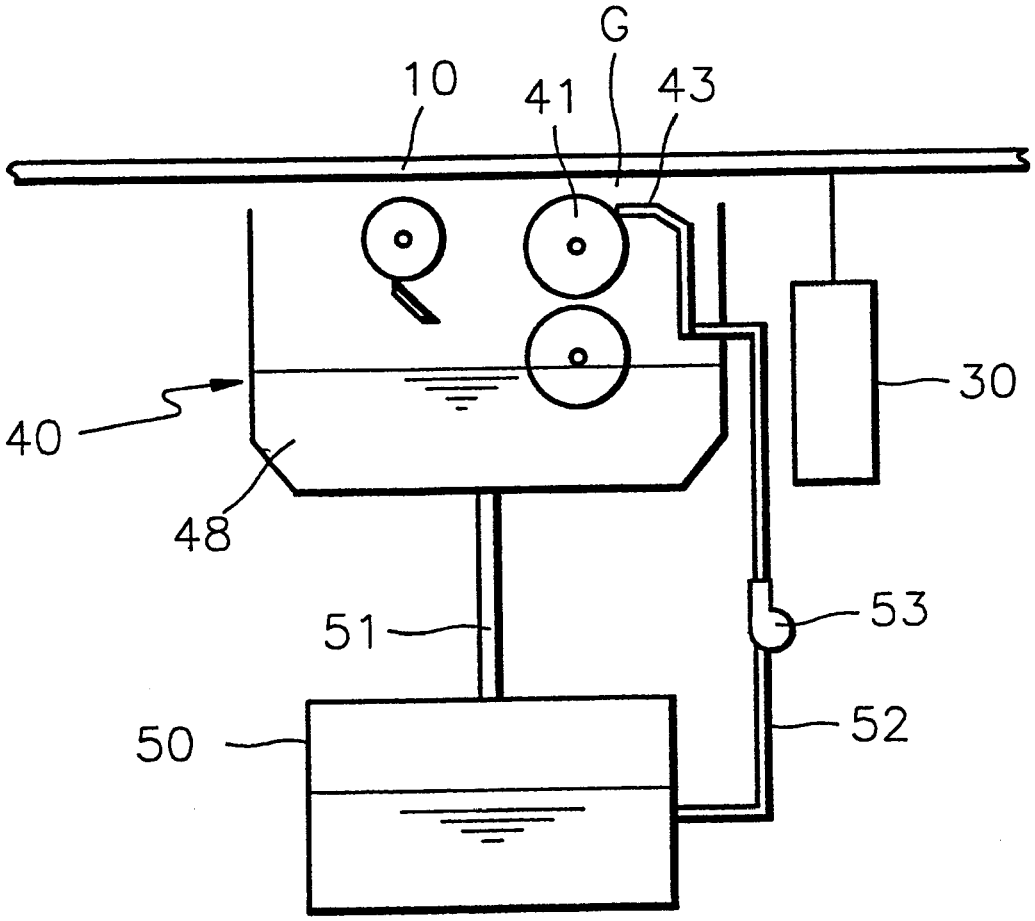
FIG. 1 is a view showing the structure of the developing unit of a common color printer.

Turing now to the drawings, FIG. 1 shows the structure of a developing unit of a conventional printer. As shown in the drawing, a developing unit 40 includes a developing roller 41 for developing an electrostatic latent image formed on a photoreceptor web 10 by a laser scanning unit 30 with developer in which toner having a predetermined color and liquid carrier are mixed in a predetermined ratio.

Also, the developer supplying apparatus includes a developer supply path 52 connecting a circulation tank 50 and a developing unit 40, a pump 53 installed on the developer supply path 52, and an injection nozzle 43 installed at the leading end of the developer supply path 52 for injecting developer between a predetermined gap G between the developing roller 41 and the photoreceptor web 10. The developing unit 40 is connected to the circulation tank 50 by a discharge pipe 51 to collect developer 48 remaining after being used for development in the developing unit 40. Thus, the developer contained in the circulation tank 50 is circulated between the developing unit 40 and the circulation tank 50 in a range of concentration allowance.

During the above circulation process, the developer may contain impurities due to fixation of toner or intrusion of foreign materials. Accordingly, it is necessary to filter impurities by installing a filter on the paths 51 and 52. However, there is no filtering means on the path to the circulation tank.

Figure 2:
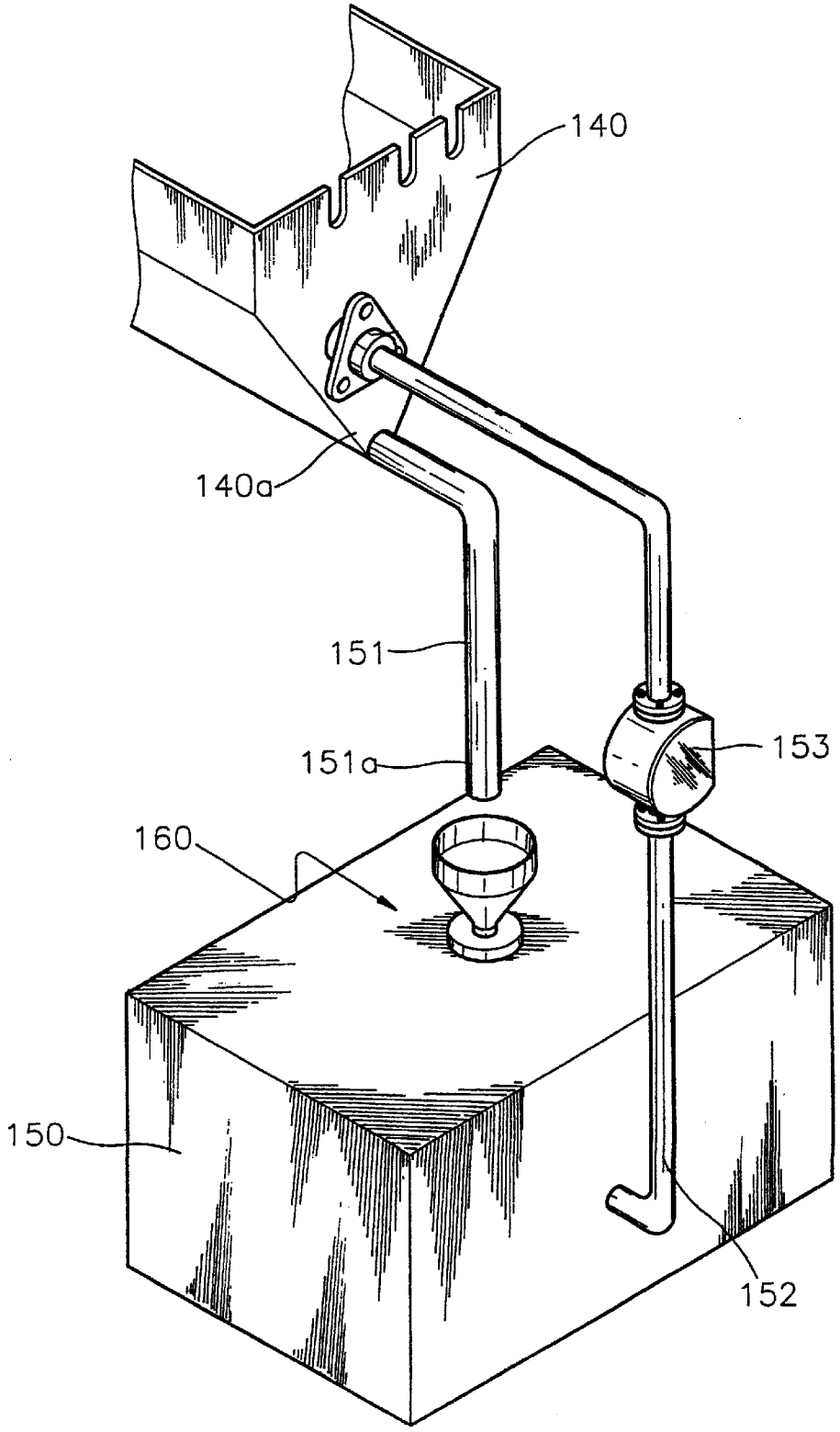
FIG. 2 is a perspective view showing a developer filtering apparatus of a printer according to a preferred embodiment of the present invention.

The present invention will now be described with reference to the drawings. Referring to FIG. 2, a developing unit 140 and a circulation tank 150 are connected via a supply path 152 and a discharge path 151. Here, one end of the discharge path 151 is coupled to an outlet 140*a* of the developing unit 140 and the other end 151*a* of the discharge path is spaced apart a predetermined distance from the circulation tank 150; that is, the other end 151*a* terminates above the circulation tank. A filter assembly 160 for filtering developer supplied from the other end 15l*a* of the discharge path 151, which will be described later, is installed above the circulation tank 150. A pump 153 for supplying the developer stored in the circulation tank 150 to the developing unit 140 is installed on the supply path 152.

Figure 3:
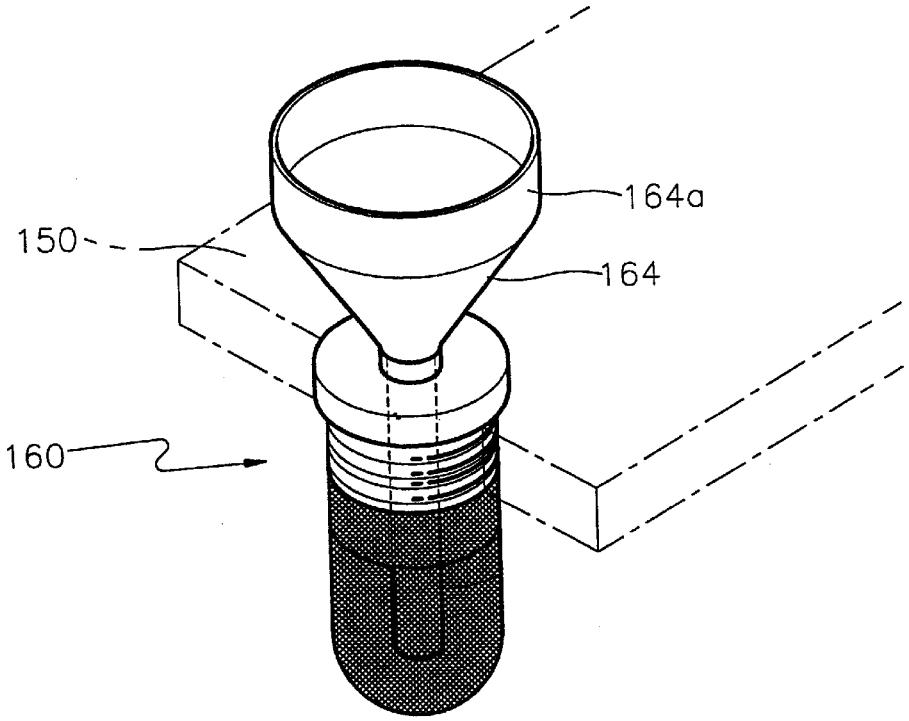
FIG. 3 is a magnified perspective view of the filtering apparatus shown in FIG. 2.
Figure 4:
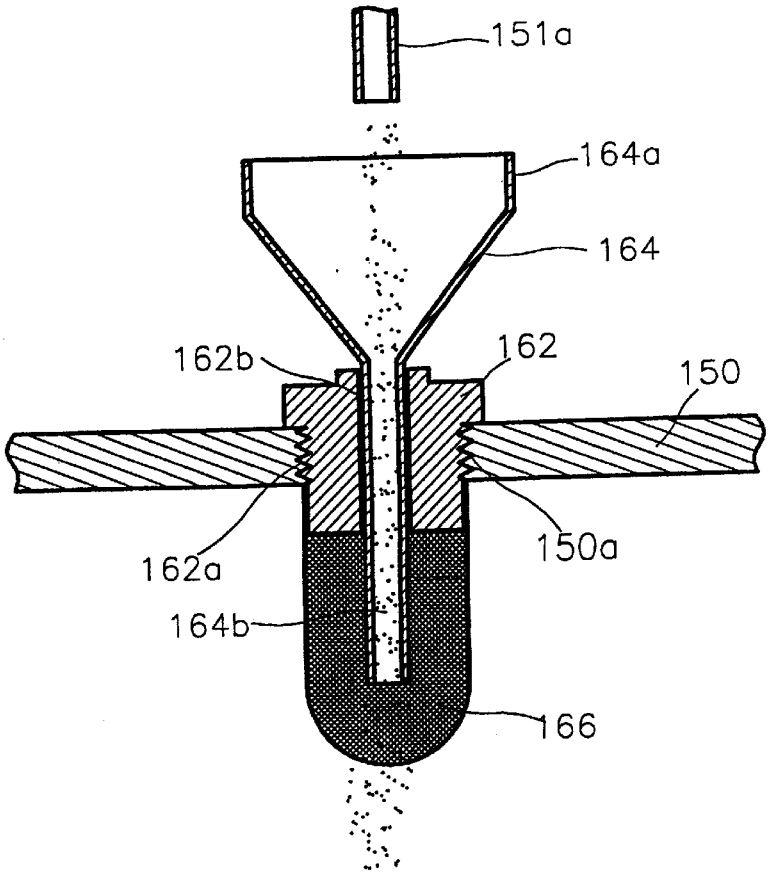
FIG. 4 is a sectional view showing the state in which the filtering apparatus shown in FIG. 3 is installed at the printer.

As shown in FIGS. 3 and 4, the filter assembly 160 comprises of a coupling member 162 coupled to a coupling hole 150*a* formed in the circulation tank 150, a receiving member 164 installed to penetrate the coupling member 162 for receiving the developer discharged from the other end 151*a* of the discharge path 151, and a filter net 166 coupled to the coupling member 162 while being wrapped around the lower portion of the receiving member 164.

The coupling member 162 has a cylindrical shape and a threaded portion 162*a* is formed on the outer circumferential surface thereof to be screw-coupled to the coupling hole 150*a* of the circulation tank 150. A hole 162*b*=l is formed at the coupling member 162 through which a stem portion of the receiving member 164 passes.

Preferably, the receiving member 164 is a funnel having a large diameter portion 164*a* and a small diameter portion 164*b*. The large diameter portion 164*a* receives the developer discharged from the other end 151*a* of the discharge path 151 and the small diameter portion 164*b* passes through the hole 162*b* of the coupling member 162, extending toward the filter net 166.

The filter net 166 is coupled to the lower portion of the coupling member 162 wrapped around the small diameter portion 164*b* of the receiving member 164 such that the developer discharged through the small diameter portion 164*b* of the receiving member 164 can be filtered and supplied to the circulation tank 150.

The operation of the filtering apparatus of a printer according to a preferred embodiment of the present invention will now be described with reference to FIGS. 2 through 4. The developer is supplied inside the developing unit 140 by the pump 153. The developer supplied is used for development and the leftover developer is discharged through the other end 151*a* of the discharge path 151. The developer discharged from the discharge path 151 is received by the large diameter portion of the receiving member 164. Then, the developer is filtered as it passes through the filter net 166 and finally stored in the circulation tank 150.

The filter assembly 160 can be easily repaired and replaced by rotating the coupling member 162 of the filter assembly 160 to separate the coupling member from the circulation tank 150. As described above, the developer filtering apparatus of a printer according to the present invention has an advantage in that the repair and replacement of the developer filtering apparatus is very easy and convenient.

It is noted that the present invention is not limited to the preferred embodiment described above, and it is apparent that variations and modifications by those skilled in the art can be effected within the spirit and scope of the present invention defined in the appended claims.

What is claimed is:

1. A developer filtering apparatus of a printer for filtering developer supplied from a developing unit to a circulation tank through an discharge path, said apparatus comprising:

a coupling member having a hole formed therein and coupled to a coupling hole formed in said circulation tank to be capable of being detached;

a receiving member extending to the inside of said circulation tank by penetrating said hole and for receiving developer discharged through said discharge path; and a filter net installed at one end of said coupling member wrapped around said receiving member for filtering developer passing through said receiving member.

2. The apparatus as claimed in claim 1, wherein said coupling member has a threaded portion formed thereon to be screw-coupled to said coupling hole.

3. The apparatus as claimed in claim 1, wherein said receiving member is comprised of:

a large diameter portion for receiving developer discharged from an end portion of said discharge path; and a small diameter portion extended from said large diameter portion and penetrating said hole of said coupling member.

4. The apparatus as claimed in claim 2, wherein said receiving member is comprised of:

a large diameter portion for receiving developer discharged from an end portion of said discharge path; and a small diameter portion extended from said large diameter portion and penetrating said hole of said coupling member.

5. A developer-filtering apparatus for a printer, comprising:

a developing unit for developing an electrostatic latent image;

a circulation tank located below said developing unit, for containing developer for circulation to the developing unit;

a supply path extending from one side of the circulation tank to an inlet at one side of the developing unit;

a pump installed in the supply path for pumping developer to the developing unit;

a discharge path, one end of said discharge path coupled to an outlet of said developing unit and the other end of said discharge path terminating at a distance above the circulation tank; and a filter assembly removably mounted in an upper surface of said circulation tank and below said other end of said discharge path, said filter assembly comprising:

a receiving member for receiving developer discharged from said other end of said discharge path;

a stem portion extending into the circulation tank; and a filter net below said stem portion, for filtering developer passing from said stem portion into the circulation tank.

6. The developer-filtering apparatus of claim 5, the top of said receiving member being below said other end of said discharge path.

7. The developer-filtering apparatus of claim 5, further comprising:

said circulation tank having a screw-threaded coupling hole in the upper surface where said filter assembly is mounted; and said filter assembly further comprising a coupling member for retaining said receiving member and stem portion, said coupling member having a cylindrical shape and having a thread on the outer circumferential surface for engaging the coupling hole of said circulation tank.

8. The developer-filtering apparatus of claim 5, further comprising:

said coupling member having an axial hole; and said stem portion passing through said axial hole.

9. The developer-filtering apparatus of claim 5, further comprising:

said receiving member and said stem portion being formed together as an integral unit.

10. The developer-filtering apparatus of claim 5, further comprising:

said receiving member being circular in cross-section.

11. The developer-filtering apparatus of claim 5, further comprising:

said receiving member being shaped as a funnel tapering toward the circulation tank.

12. The developer-filtering apparatus of claim 11, further comprising:

said receiving member being shaped as a conical funnel.

13. The developer-filtering apparatus of claim 10, said receiving member farther comprising:

a cylindrical large diameter portion at the at the top of the receiving member.

14. The developer-filtering apparatus of claim 7, further comprising:

said coupling member having a lower portion extending into the circulation tank; and said filter net being coupled to the lower portion of the coupling member and wrapping around said stem portion.

15. The developer-filtering apparatus of claim 14, further comprising:

said filter net having a cylindrical portion having approximately the same diameter as and encircling the lower portion of the coupling member.

16. The developer-filter apparatus of claim 15, sad filter net further comprising:

a rounded portion terminating the cylindrical portion of the filter net below said stem portion.

17. A developer-filtering apparatus for a printer, comprising:

a developing unit for developing an electrostatic latent image;

a circulation tank located below said developing unit, for containing developer for circulation to the developing unit, said circulation tank having a screw-threaded coupling hole in the upper surface;

a supply path extending from one side of the circulation tank to an inlet at one side of the developing unit;

a pump installed in the supply path for pumping developer to the developing unit;

a discharge path, one end of said discharge path coupled to an outlet of said developing unit and the other end of said discharge path terminating at a distance above the coupling hole in the circulation tank; and a filter assembly removably mounted in an upper surface of said circulation tank and below said other end of said discharge path, said filter assembly comprising:

a coupling member having a cylindrical shape, having an axial hole penetrating the coupling member, and further comprising:

a thread on an outer circumferential surface for engaging the coupling hole of the circulation tank; and is a lower portion extending into the circulation tank; and a receiving member formed integrally, comprising:

a small diameter stem portion penetrating the axial hole of the coupling member;

a conical fuel portion extending from the stem portion at a region above the top of the coupling member, said conical funnel portion widening upward; and a large diameter portion having a cylindrical shape, connected to the upper portion of said conical funnel portion, the top of said large diameter portion being located below the other end of the discharge path.

18. A method for filtering developer in a printer, comprising the steps of:

removably mounting a filter assembly having a conical funnel-shaped receiving member in an upper surface of a circulation tank of the printer with the conical portion above the circulation tank and the stem portion of the funnel penetrating the circulation tank and having a filter net wrapping around the lower portion of the stem portion;

discharged developer from a developing unit from a discharge path leading from one end at an output of the developing unit through the other end of the discharge path located above the top of conical portion of the filter assembly;

receiving the discharged developer in a funnel-shaped receiving member; and passing the discharged developer through the stem portion and through the filter net into the circulation tank.

19. The method of claim 18, further comprising the step of:

changing the filter assembly by removing the filter assembly by unscrewing a coupling member holding the receiving member, from a threaded coupling hole in the top of the circulation tank.

* * * * *